US011087725B1

(12) United States Patent
Fenwick

(10) Patent No.: US 11,087,725 B1
(45) Date of Patent: Aug. 10, 2021

(54) UNIVERSAL DRUMSTICK

(71) Applicant: Travis A. Fenwick, Wincheter, KY (US)

(72) Inventor: Travis A. Fenwick, Wincheter, KY (US)

(73) Assignee: Bongo Peckers, LLC, Cramerton, NC (US)

( * ) Notice: Subject to any disclaimer, the term of this patent is extended or adjusted under 35 U.S.C. 154(b) by 0 days.

(21) Appl. No.: 17/062,076

(22) Filed: Oct. 2, 2020

(51) Int. Cl.
*G10D 13/12* (2020.01)

(52) U.S. Cl.
CPC ..... *G10D 13/12* (2020.02)

(58) Field of Classification Search
CPC ..... G10D 13/12; G10D 13/00; G10D 3/00
See application file for complete search history.

(56) References Cited

U.S. PATENT DOCUMENTS 7,375,271 B1 * 5/2008 Zelinsky ..... G10D 13/12 84/422.4

* cited by examiner

*Primary Examiner* — Kimberly R Lockett
(74) *Attorney, Agent, or Firm* — Malcolm E. Whittaker; Whittaker Law Firm

(57) ABSTRACT

A universal drumstick for use by a drummer, the drummer having a hand with a thumb, an index finger, a middle finger, a ring finger, and a pinkie finger, comprising, a distal tip, a shaft proximal to the distal tip, a handle proximal to the shaft, the handle having a grip therethrough, the grip sized to allow the drummer's little finger and ring finger to extend therethrough, the shaft angled relative to the handle such that at least a portion of the shaft is above the drummer's middle and index fingers when the drummer's pinkie and ring fingers are within the grip, whereby the drummer can play a stick-drum with the universal drumstick and also play a hand-drum without removing the universal drumstick from the drummer's hand.

19 Claims, 12 Drawing Sheets

UNIVERSAL DRUMSTICK

CROSS-REFERENCE TO RELATED APPLICATIONS

None

STATEMENT REGARDING FEDERALLY SPONSORED RESEARCH

Not Applicable.

TECHNICAL FIELD OF THE INVENTION

The present invention relates generally to drumsticks and more specifically to a drumstick that allows a drummer to strike a drum's drumskin with the drumstick and also strike the drumskin with the drummer's hand while still holding the drumstick.

BACKGROUND OF THE INVENTION

Drums are percussive instruments that have existed for thousands of years. FIG. 1A illustrates typical stick-drum D. Typically, the drum D has a membrane M also known as a "drumhead" or "drumskin" that is pulled tight over a drum's frame. When the drummer strikes the drumskin, also referred to as "beats" or "beating," the drum produces a sound. Typically, the drummer will use a drumstick S to strike the drumskin to produce a sound or a series of sounds. FIG. 1A also illustrates a pair of conventional drumsticks S. When the drummer engages in this process, he is "playing" the drum. For many years, stick-drums were the primary type of percussive instrument used by bands and musicians in general. Of the years a variety of stick-drums developed. By way of non-limiting example, other examples of stick-drums are a timpani, a snare drum, a triangle, a chime, and, a bass drum. Additional musical instruments that may be played using the drumstick to play the instrument are, by way of non-limiting example, a cymbal, a triangle, a gong, a block, a bell, a cow bell, a tambourine, a maraca, a high-hat, a clave, and a chime.

FIG. 1B illustrates the right hand of the drummer playing drum D. FIG. 1B illustrates the typical names of each of the digits of a human hand. Namely, a pinkie finger, a ring finger, a middle finger, an index finger, and a thumb. Other names may be used. When a specific digit(s) is referred to it refers to the one referred in FIG. 1B. Of course, the same digits are found on both the left hand and right hand. The top of the hand may be referred to as the back of the hand and the bottom of the hand may be referred to as the palm of the hand.

Since the development of stick-drums, other types of percussive instruments have been developed. Percussive instruments such as bongo drums and conga drums are among the more recent additions to the musical world. Generally speaking, bongos and congas are played with the fingers and palms of the player's hands. FIG. 2 illustrates a typical bongo drum B (left) and a typical conga drum C (right). Thus, bongos B and congas C may be thought of as "hand-drums", as opposed to a drum played with a drumstick, which was referred to above as "stick-drums" D. In general, bongos B produce higher pitched percussive sounds than conventional drums played with a drumstick. Bongos B and congas C may also produce a deeper base sound, unless slapped which may produce a flat crisp beat. Typically, the bongo B or conga C drummer will strike the drumskin in different locations or with different parts of the hand to produce different sounds. For example, a bongo player seeking to produce an open tone will strike the drumskin with four fingers near the rim of the bongo. As an alternative example, the drummer could strike the drumskin with the palm of his hand near the center to produce a bass sound. These are not all of the types of sounds that may be produced by playing a percussive instrument with the hands, but are merely non-limiting illustrative examples. In general, bongos B are smaller than congas C and are held in the users hands and lap while being played. Typically, congas C are larger than bongos B and rest on the floor and are also played by hand. The use of congas and bongos as examples of hand-drums are intended as non-limiting examples.

With respect to percussive instruments that are played with a drumstick, different sounds are produced when the drumstick strikes different portions of the drumskin of the drum. However, when the drummer wants to switch between playing a stick-drum (using a drumstick) and a hand-drum, he must put down the drumstick, strike the drumskin of the hand-drum with his hands, pick the drumstick back up, correctly position the drumstick in his hands, and resume playing the stick-drum; all without dropping the drumstick. Of course, if the drummer drops the drumsticks or picks the drumsticks up and incorrectly positions it in his hands, this will interfere with his playing. In addition, if the drummer is playing in a band, he will fall behind the other members of the band while they are playing. In the modern era, music may include sounds produced by both stick-drums and hand-drums. As many songs that incorporate hand-drums are fast paced music, falling behind the pace of the other band members would likely produce discordant music. While stick-drums and hand-drums may both be generically thought of as drums, they are different types of drums. The universal drumstick allows a drummer to play a hand-drum without first putting down his drumsticks. Similarly, a drummer can play a hand-drum, and without pausing to pick up his drumsticks, begin playing a stick-drum.

Alternatively, to avoid the problems associated with picking up and putting down drumsticks, a musical band may employ one musician to play the hand-drums and another musician to play the stick-drums. While this means that the stick-drum drummer will not need to pick up and put down his drumsticks and the hand-drummer will also not need to pick up or put down drumsticks, it increases the number of band members. As space is at a premium in many musical venues, increasing the number of band members occupies valuable space. Also, when the band tours to venues in different locations, the costs associated with traveling to non-local venues, such as lodging, transportation, and food, can be significant. If a single drummer can fulfill these tasks, these costs can be avoided.

As it is desirable to allow the drummer to produce the sounds produced by stick-drums and hand-drums without the requirement to pick up and put down drumsticks, the universal drumstick is a significant improvement over the current conventional drumsticks. Alternatively described, the universal drumstick allows the band to include both stick-drums and hand-drums and use one drummer to play both instruments.

As disclosed and taught in the following materials, a variety of methods and apparatus may be used in with the present apparatus.

BACKGROUND

Earlier devices attempted to address this problem of putting down and picking up drumsticks to switch between stick-drums and hand-drums have not resolved the problem.

For example, U.S. Pat. No. 7,601,903, issued to Elmer W. Monk on Oct. 13, 2009, in which a drummer's drumstick holder is disclosed comprising a rigid, circumscribed frame having a woven web of elastic bands therein forming a matrix of openings within which the drumsticks may be inserted. The frame is secured to the drum set by elastic straps affixed to the drum set and/or other accompanying musical pieces.

As another example, U.S. Pat. No. 8,168,874, issued to Ronald K. Watson on May 1, 2012, is directed to a drumstick gripping aid. In one embodiment, the drumstick gripping aid includes a first strap having two loops and a second strap having one loop interconnected thereto. The first strap is adapted to fit about at least two fingers of a user while the second strap is adapted to fit about an outer circumference of a drumstick. In another embodiment, a drumstick gripping aid includes a single strap having two loops. In one variation, a first loop is adapted to fit about one finger of a user while a second loop is adapted to fit about an outer circumference of a drumstick. In another, the first loop and the second loop are adapted to fit about at least two fingers of the user, the drumstick gripping aid fixedly attached to a drumstick.

Another example, U.S. Pat. D815,192, issued to Donnie D. Kulcsar, on Apr. 10, 2018, illustrates a drumstick gripping device.

Still another example, is the drummer wearing gloves to make it less likely that he will drop a drumstick when he is picking it up or putting it down.

SUMMARY OF THE INVENTION

A universal drumstick for use by a drummer, the drummer having a hand with a thumb, an index finger, a middle finger, a ring finger, and a pinkie finger, comprising, a distal tip, a shaft proximal to the distal tip, a handle proximal to the shaft, the handle having a grip therethrough, the grip sized to allow the drummer's little finger and ring finger to extend therethrough, the shaft angled relative to the handle such that at least a portion of the shaft is above the drummer's middle and index fingers when the drummer's pinkie and ring fingers are within the grip, whereby the drummer can play a stick-drum with the universal drumstick and also play a hand-drum without removing the universal drumstick from the drummer's hand.

These and other embodiments will be more fully appreciated from the description below.

DESCRIPTION OF THE PREFERRED EMBODIMENTS

Corresponding reference numbers indicate corresponding parts throughout the several views of the drawings and specification.

Figure 3A:
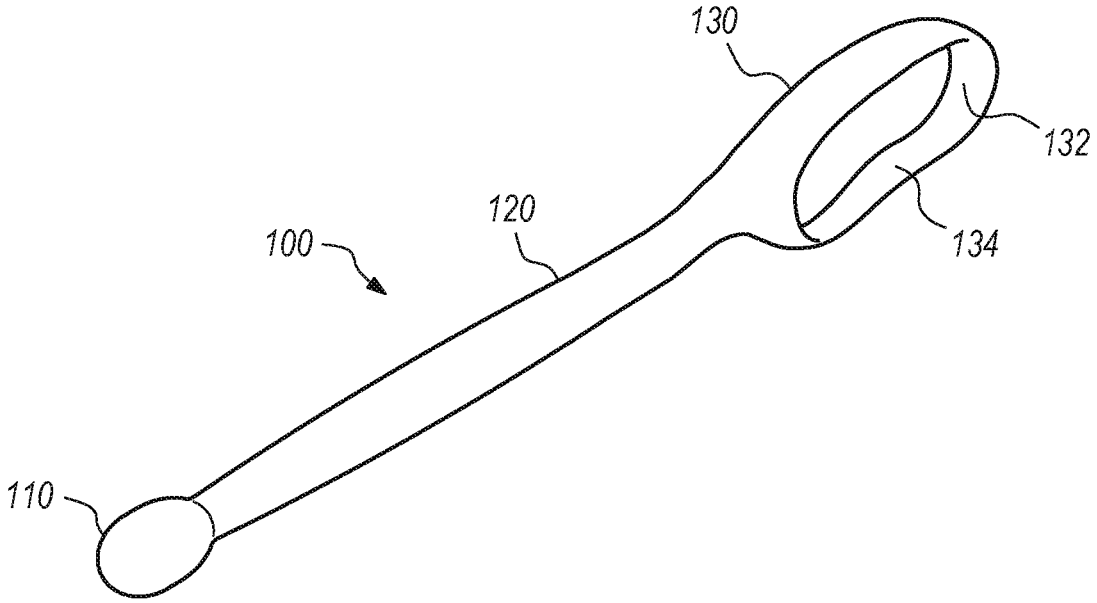
FIG. 3A illustrates a perspective view of a universal drumstick.

FIG. 3A illustrates a perspective view of a universal drumstick 100. Universal drumstick 100 comprises a tip 110, a shaft 120, and a handle 130. A grip 132 is disposed therethrough handle 130. In a preferred embodiment, a curve 134 is within grip 132 and is inwardly contoured. When universal drumstick 100 is in use, preferably, curve 134 contours with the drummer's pinkie and ring fingers and particularly the interstitial space between the drummer's pinkie and ring fingers.

When used, the term "proximal" means closer to the drummer's body and the term "distal" means further away from the drummer's body. Thus, when the drummer is playing the drums using universal drumstick 100, tip 110 is distal to shaft 120. Correspondingly, shaft 120 is proximal to tip 110. By way of another example, in human anatomy, the wrist joint is distal to the elbow joint. Correspondingly, it can be said that the elbow joint is proximal to the wrist joint. The terms might also be thought of as further away and closer to the drummer's body. When used, the term "bottom" refers to the surface below the top surface. For example, the palm of the drummer's hand may be described as the bottom of the hand and the back of the hand may be referred to as the back or top of the hand. This top and bottom description is particularly apparent if a person is holding their hands parallel to the floor with the palms open and facing toward the floor.

Figure 3B:
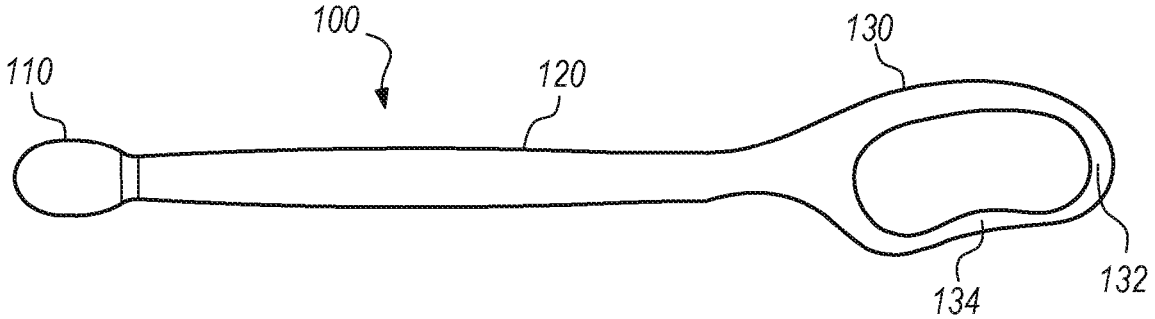
FIG. 3B illustrates a right side view of the universal drumstick. The left side view is a mirror image.

FIG. 3B illustrates left side view of the universal drumstick 100. Grip 132 is disposed therethrough handle 130. In a preferred embodiment, curve 134 is within grip 132 and is inwardly contoured. When universal drumstick 100 is in use on a drummer's hand, curve 134 contours with the drummer's pinkie and ring fingers and particularly the interstitial space between the drummer's pinkie and ring fingers.

Figure 3C:
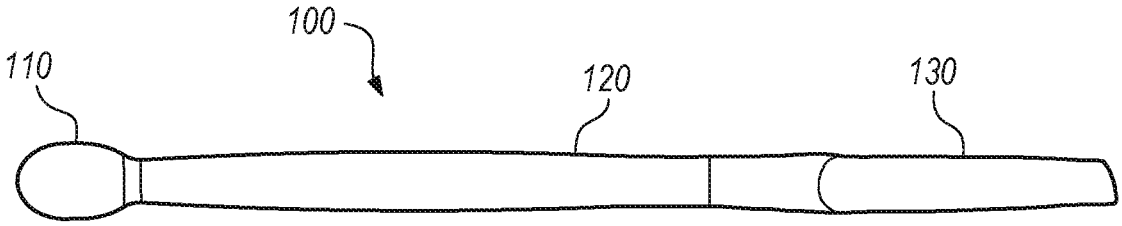
FIG. 3C illustrates a top view of the universal drumstick.

FIG. 3C illustrates is a top view of the universal drumstick 100. Tip 110, shaft 120, and grip 130 are also illustrated.

Figure 3D:
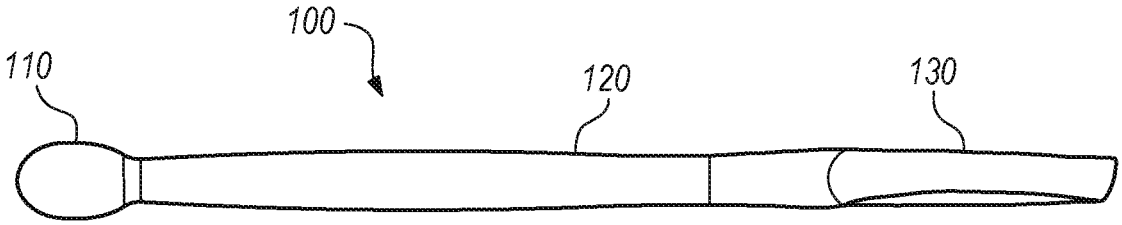
FIG. 3D illustrates a bottom view of the universal drumstick.

FIG. 3D illustrates a bottom view of the universal drumstick 100. Tip 110, shaft 120, and grip 130 are also illustrated.

Figure 3E:
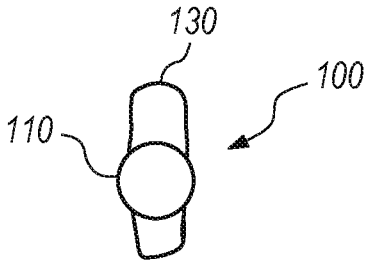
FIG. 3E illustrates a front view of the universal drumstick.

FIG. 3E illustrates a front view of the universal drumstick 100. Grip 130 is also illustrated.

Figure 3F:
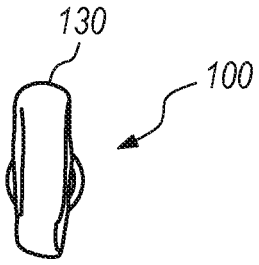
FIG. 3F illustrates a rear view of the universal drumstick.

FIG. 3F illustrates a rear view of universal drumstick 100. Grip 130 is also illustrated.

Figure 1A:
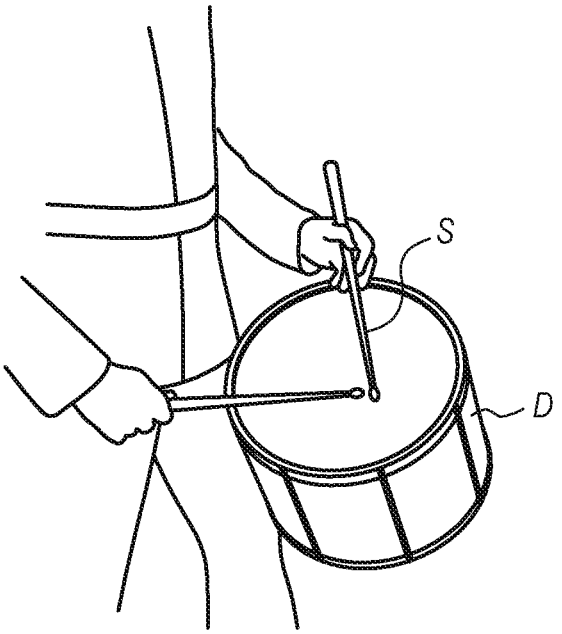
FIG. 1A illustrates a conventional stick-drum that is typically played with conventional drumsticks.
Figure 1B:
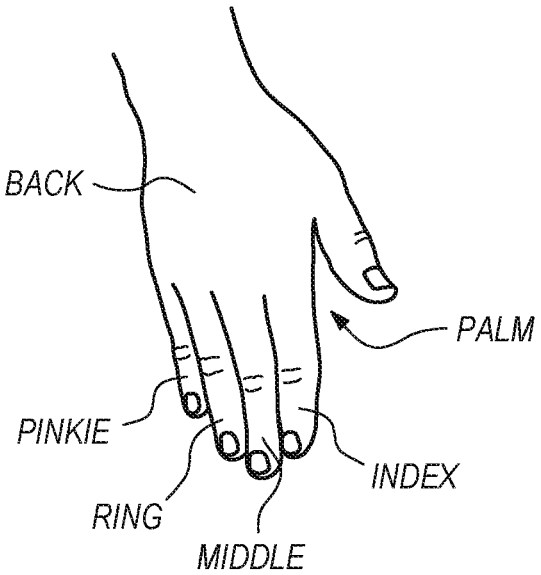
FIG. 1B illustrates a close up view of the fingers of the drummer's right hand.
Figure 2:
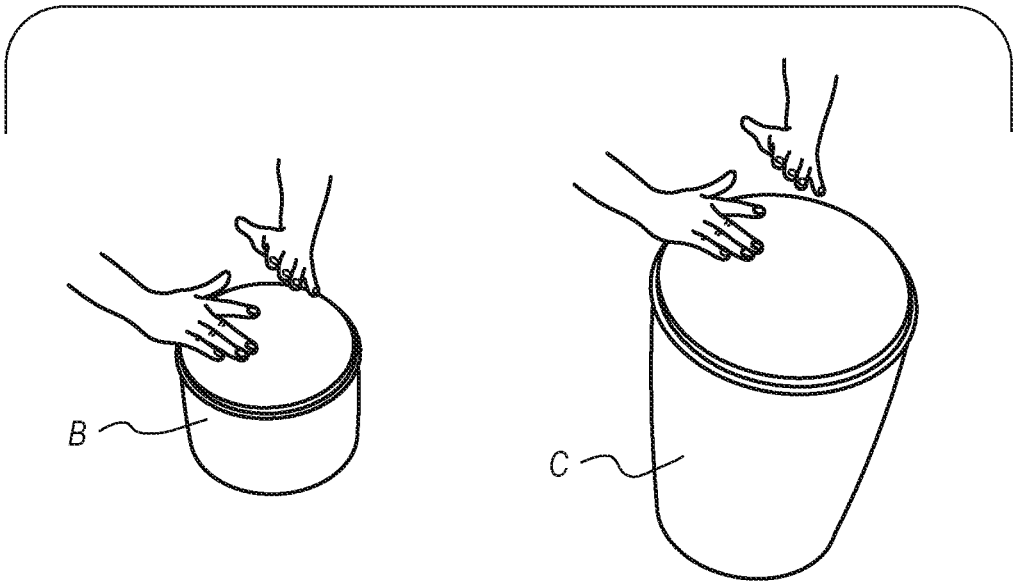
FIG. 2 illustrates a typical bongo drum on the left and a typical conga drum on right. As discussed above, bongo and conga drums are typical hand-drums.
Figure 4A:
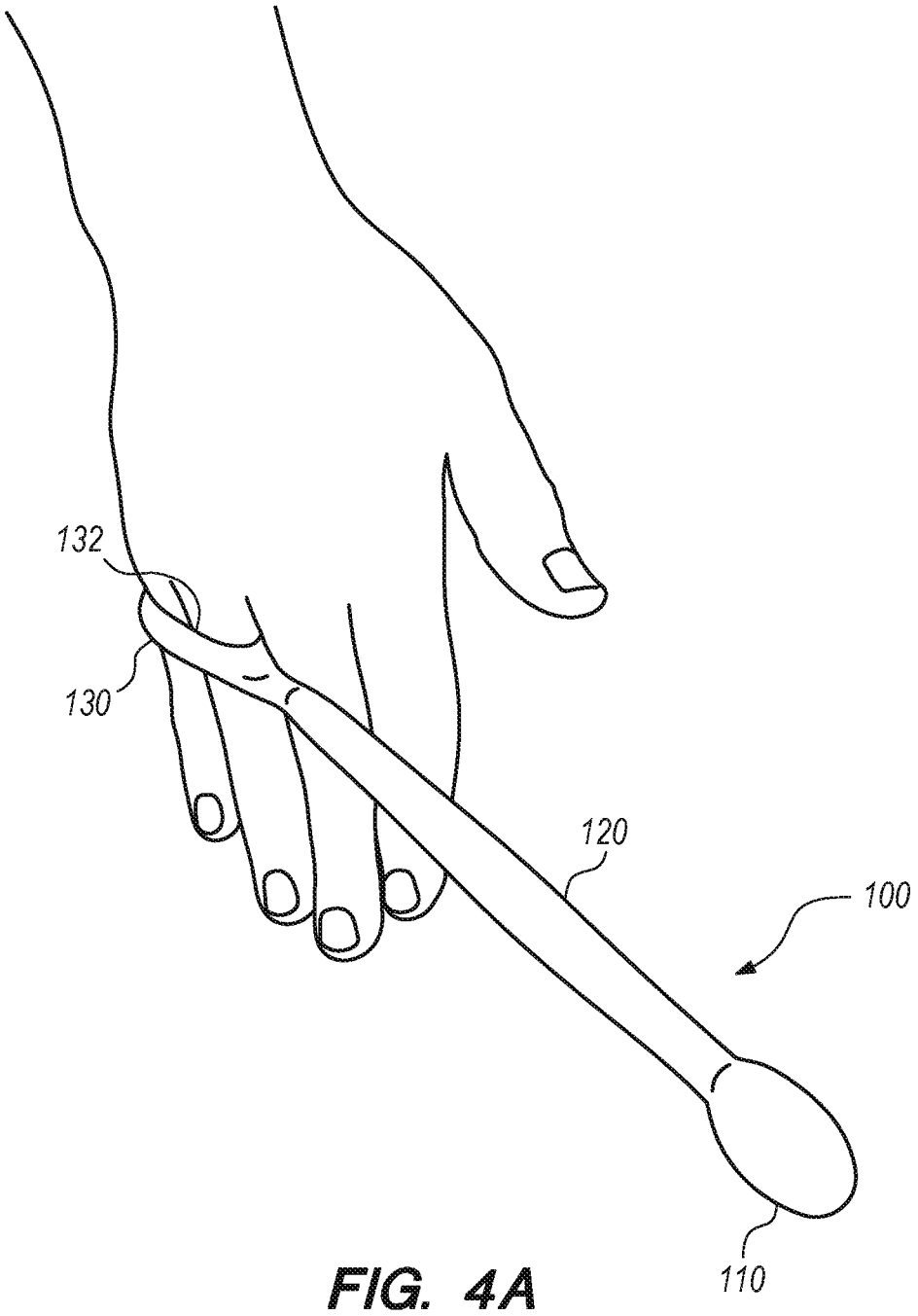
FIG. 4A illustrates a perspective view of a drummer's right hand using the universal drumstick.
Figure 4B:
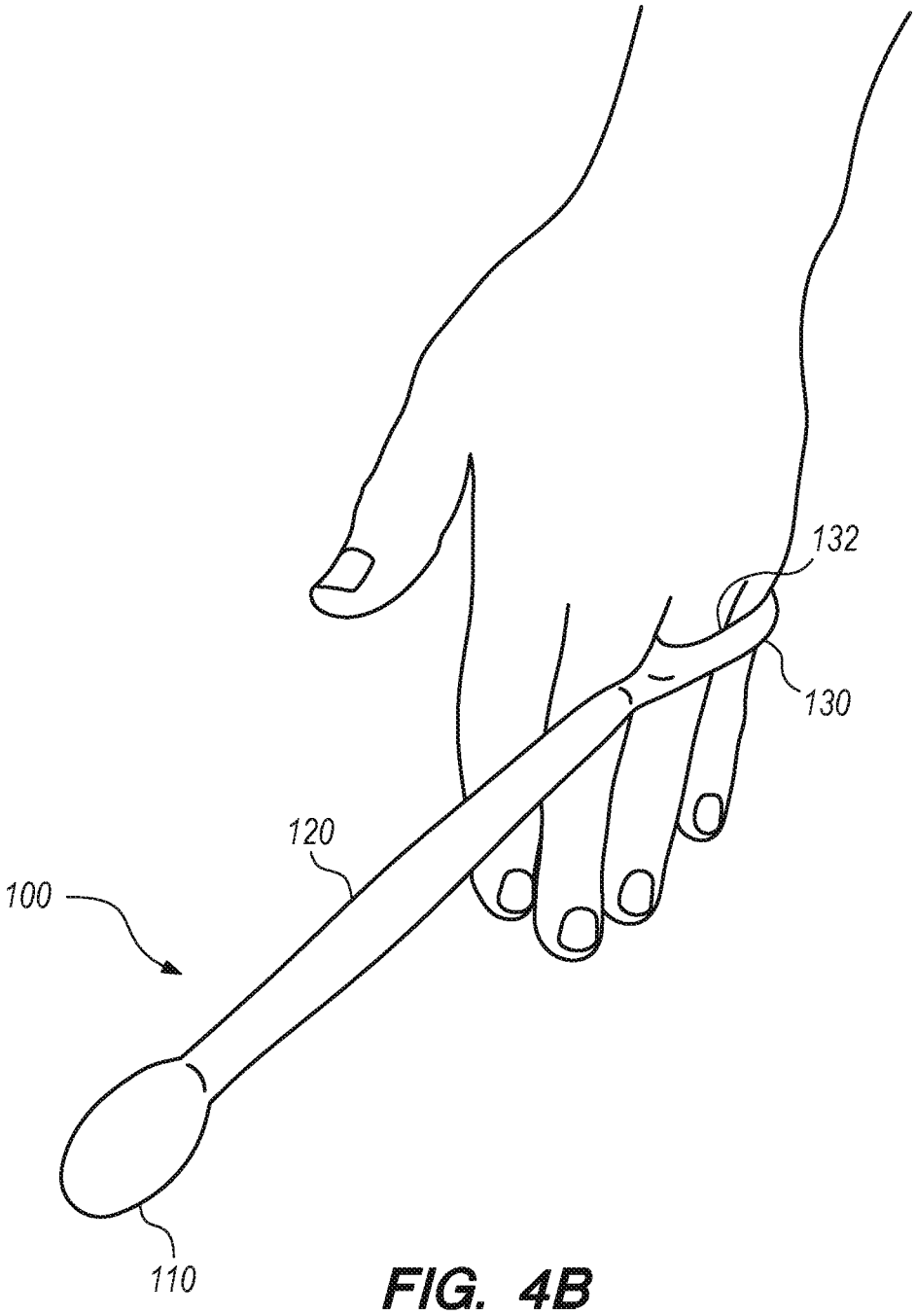
FIG. 4B illustrates a perspective view of a drummer's left hand using the universal drumstick.

FIG. 4A illustrates universal drumstick 100 positioned on the drummer's right hand. When the drummer slides his pinkie and ring finger therethrough grip 130, at least a portion of shaft 120 is positioned above the drummer's middle and index fingers, i.e. on top of the drummer's middle and index fingers. Unlike conventional drumsticks illustrated in FIG. 1A, the drummer's fingers are not wrapped around the conventional drumstick. Phrased differently, when using universal drumstick 110, the drummer's palm is open. As illustrated in FIG. 2, when the drummer's palm is open, he can play hand-drums such as bongos or congas. FIG. 4A also illustrates the grip 132 therethough handle 130 is sized to allow the drummer's little finger and ring finger to extend therethrough, the shaft 120 is angled relative to the handle 130 such that at least a portion of the shaft 120 is above the drummer's middle and index fingers when the drummer's pinkie and ring fingers are within the grip Similarly, FIG. 4B illustrates universal drumstick 100 positioned on the drummer's left hand. When the drummer slides his pinkie and ring finger therethrough grip 130, at least a portion of shaft 120 is positioned above the drummer's middle and index fingers. Unlike conventional drumsticks illustrated in FIG. 1, the drummer's fingers are not wrapped around the conventional drumstick. Phrased differently, when using universal drumstick 100, the drummer's palm is open. As illustrated in FIG. 2, when the drummer's palm is open, he can play hand-drums such as bongos or congas. FIG. 4B also illustrates the grip 132 therethough handle 130 is sized to allow the drummer's little finger and ring finger to extend therethrough, the shaft 120 is angled relative to the handle 130 such that at least a portion of the shaft 120 is above the drummer's middle and index fingers when the drummer's pinkie and ring fingers are within the grip.

Experimental use has determined that it is possible for the drummer to play both stick-drums and hand-drums with the universal drumstick 100 with the ring finger and middle finger slid therethough grip 130.

FIGS. 4A and 4B illustrate the universal drumstick can be used to play both hand-drums and stick-drums without the need to put down or pick up universal drumstick 100.

Figure 8:
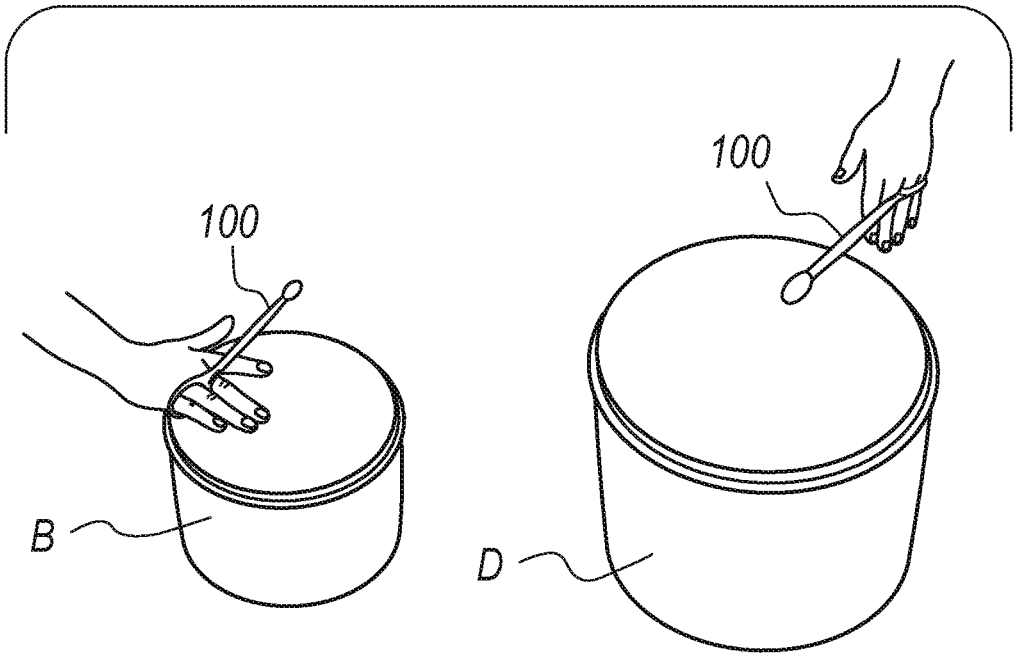
FIG. 8 illustrates a perspective view of the drummer using the universal drumstick to play a hand-drum and a stick-drum.

FIGS. 4A, 4B, and 8 illustrate that the drummer's palm is open and the drummer can play a hand-drum B or C with his fingers and palm without removing universal drumstick 100. Correspondingly, the drummer may also use the universal drumstick 100 to play stick-drum D.

Figure 5A:
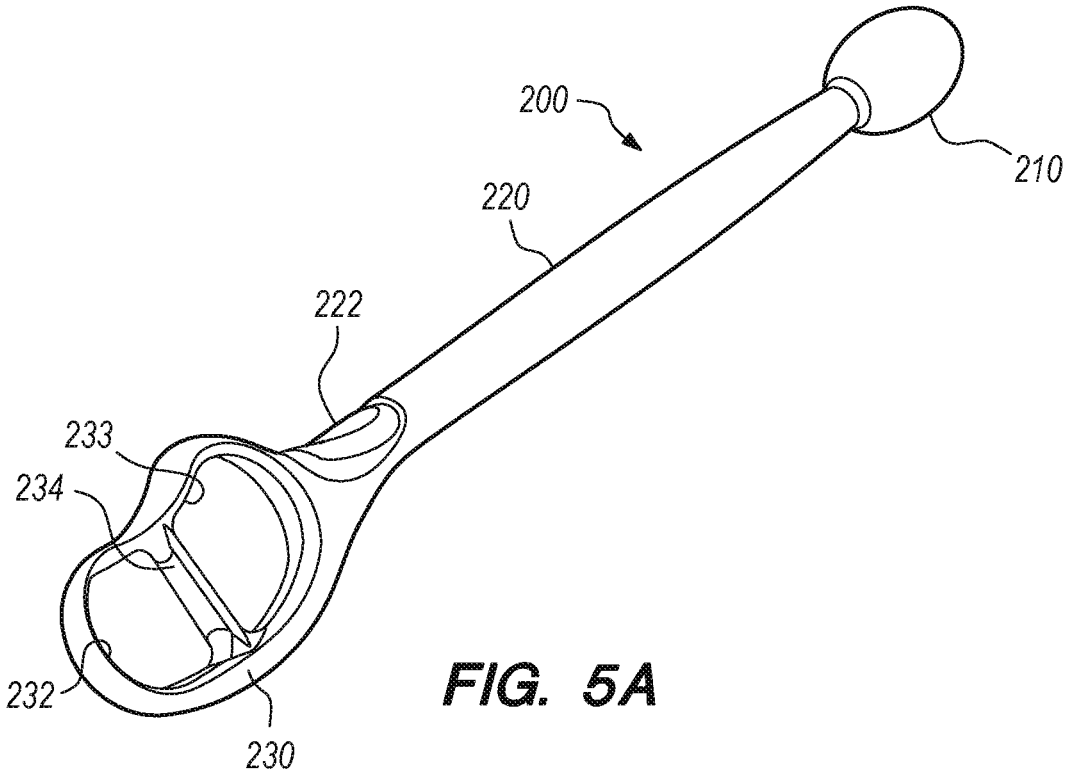
FIG. 5A illustrates a perspective view of a first alternative embodiment of the universal drumstick.

FIG. 5A illustrates a perspective view of a first alternative embodiment of universal drumstick 200. Universal drumstick 200 comprises a tip 210, a shaft 220, and a handle 230. A pinkie-hole 232 and a ring-finger hole 233 are disposed therethrough handle 230. In a preferred embodiment, a curve 234 is within grip 230 and is inwardly contoured. When universal drumstick 200 is in use, preferably, curve 234 contours with the drummer's pinkie and ring fingers and particularly the interstitial space between the drummer's pinkie and ring fingers.

Figure 5B:
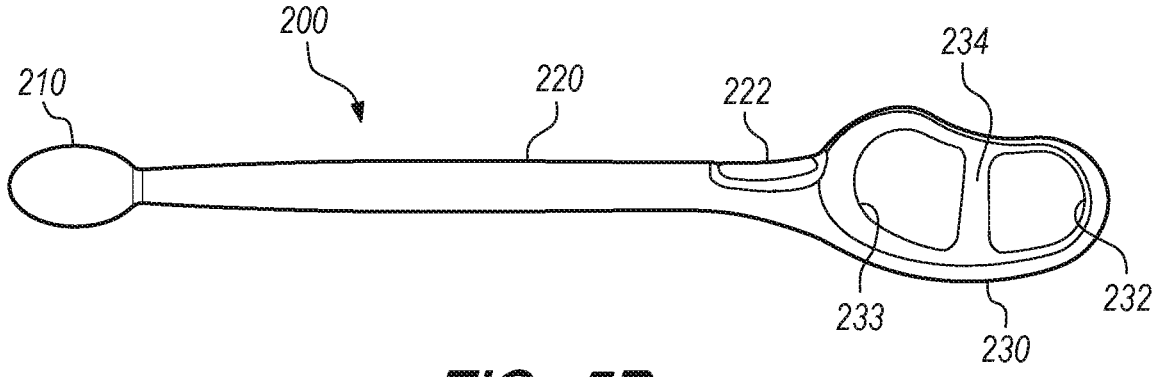
FIG. 5B illustrates a right side view of the first alternative embodiment of the universal drumstick. The left side view is a mirror image.

FIG. 5B illustrates left side view of the universal drumstick 200. The pinkie-hole 232 and a ring-finger hole 233 are disposed therethrough handle 230. In a preferred embodiment, the curve 234 is within grip 230 and is inwardly contoured. When universal drumstick 200 is in use, preferably, curve 234 contours with the drummer's pinkie and ring fingers and particularly the interstitial space between the drummer's pinkie and ring fingers.

Figure 5C:
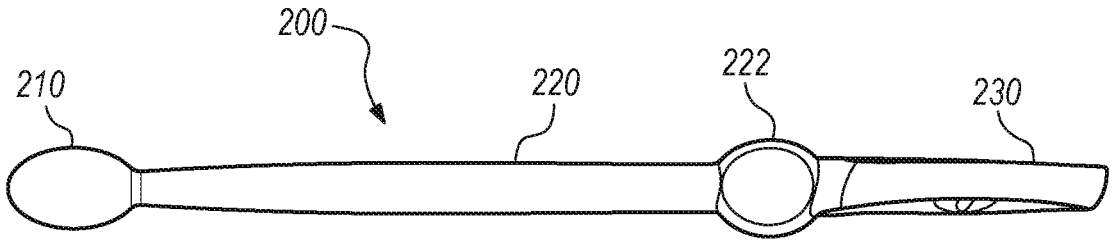
FIG. 5C illustrates a bottom view of the first alternative embodiment universal drumstick.

FIG. 5C illustrates is a bottom view of the universal drumstick 200. Tip 210, shaft 220, and grip 230 are also illustrated. As a further preferred embodiment, universal drumstick 200 comprises finger pad 222. Finger pad 222 is discussed in greater detail below.

Figure 5D:
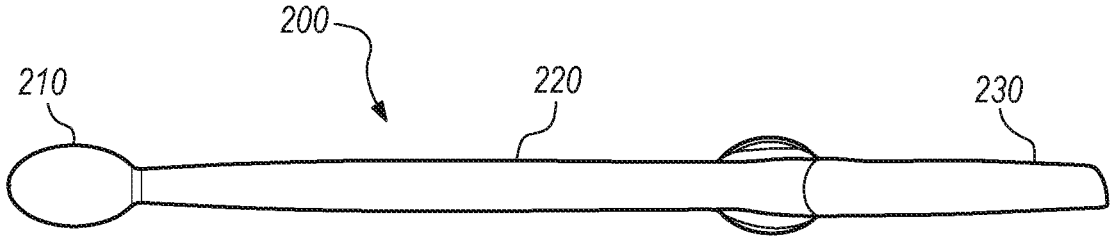
FIG. 5D illustrates a top view of first alternative embodiment the universal drumstick.

FIG. 5D illustrates a top view of the universal drumstick 200. Tip 210, shaft 220, and grip 230 are also illustrated.

Figure 5E:
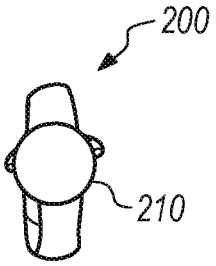
FIG. 5E illustrates a front view of first alternative embodiment the universal drumstick.

FIG. 5E illustrates a front view of the universal drumstick 200.

Figure 5F:
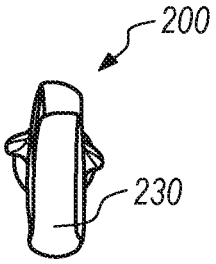
FIG. 5F illustrates a rear view of first alternative embodiment the universal drumstick.

FIG. 5F illustrates a rear view of the universal drumstick 200. Grip 230 is also illustrated.

Figure 6A:
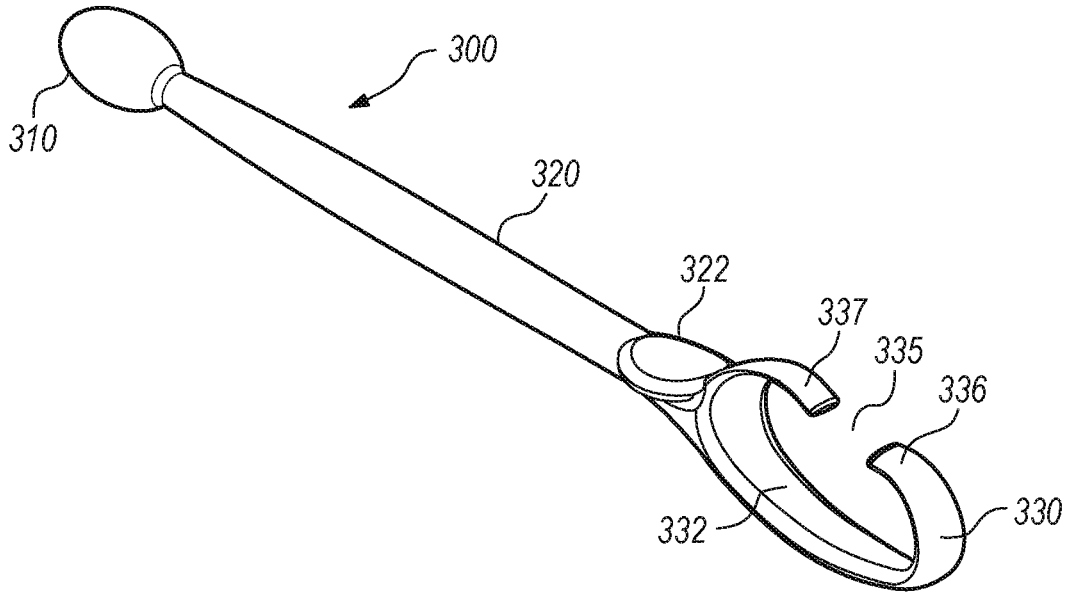
FIG. 6A illustrates a perspective view of a second alternative embodiment of the universal drumstick.

FIG. 6A illustrates a perspective view of a second alternative embodiment of universal drumstick 300. Universal drumstick 300 comprises a tip 310, a shaft 320, and a handle 330. In a preferred embodiment, handle 330 further comprises grip 332, a gap 335, and opposing segments 336 and 337. When universal drumstick 300 is in use, preferably, segments 336 and 337 contour with the drummer's pinkie and ring fingers and gap 335 is situated proximate the interstitial space between the drummer's pinkie and ring fingers.

Figure 6B:
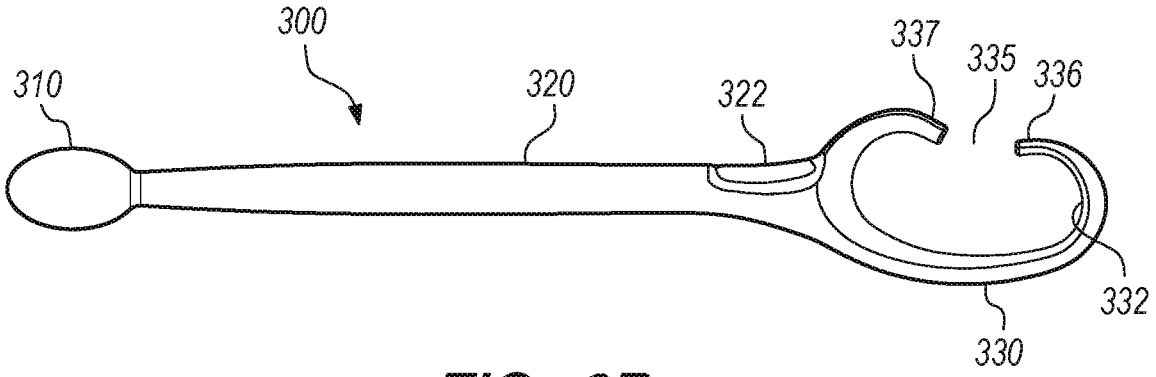
FIG. 6B illustrates a right side view of the second alternative embodiment of the universal drumstick. The left side view is a mirror image.

FIG. 6B illustrates left side view of the universal drumstick 300. Grip 332 is disposed therethrough handle 330. In a preferred embodiment, handle 330 further comprises the grip 332, the gap 335, and the opposing segments 336 and 337. When universal drumstick 300 is in use, preferably, segments 336 and 337 contour with the drummer's pinkie and ring fingers and gap 335 is situated proximate the interstitial space between the drummer's pinkie and ring fingers.

Figure 6C:
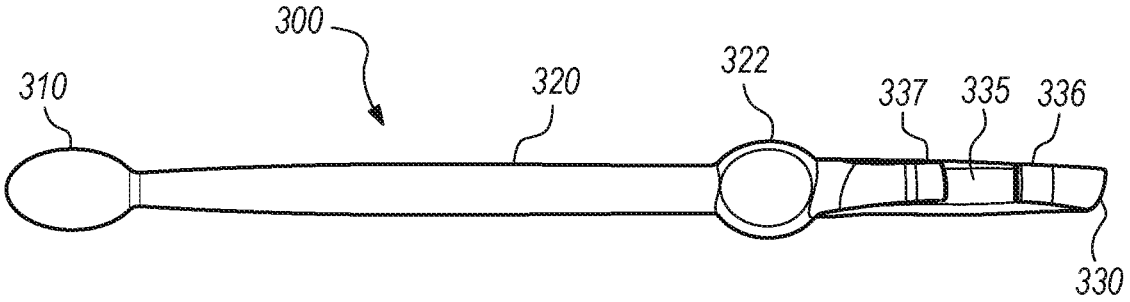
FIG. 6C illustrates a bottom view of the second alternative embodiment universal drumstick.

FIG. 6C illustrates is a bottom view of the universal drumstick 300. Tip 310, shaft 320, and grip 330 are also illustrated. As a further preferred embodiment, universal drumstick 300 comprises finger pad 322.

Figure 6D:
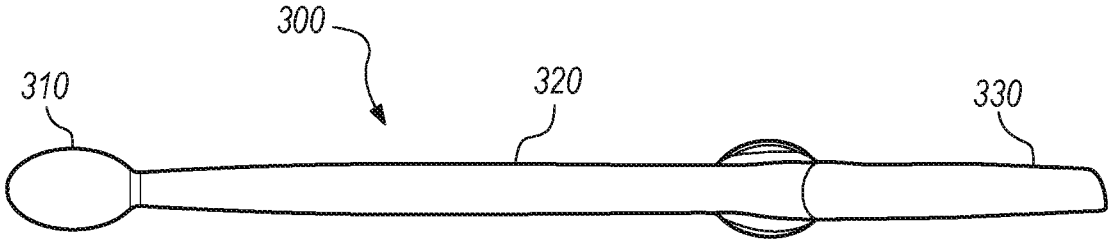
FIG. 6D illustrates a top view of second alternative embodiment the universal drumstick.

FIG. 6D illustrates a top view of the universal drumstick 300. Tip 310, shaft 320, and grip 330 are also illustrated.

Figure 6E:
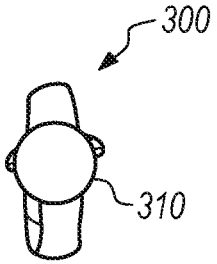
FIG. 6E illustrates a front view of second alternative embodiment the universal drumstick.

FIG. 6E illustrates a front view of the universal drumstick 300.

Figure 6F:
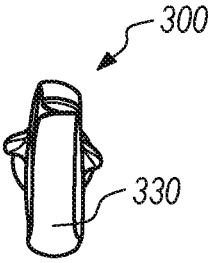
FIG. 6F illustrates a rear view of second alternative embodiment the universal drumstick.

FIG. 6F illustrates a rear view of universal drumstick 300. Grip 330 is also illustrated.

Figure 7A:
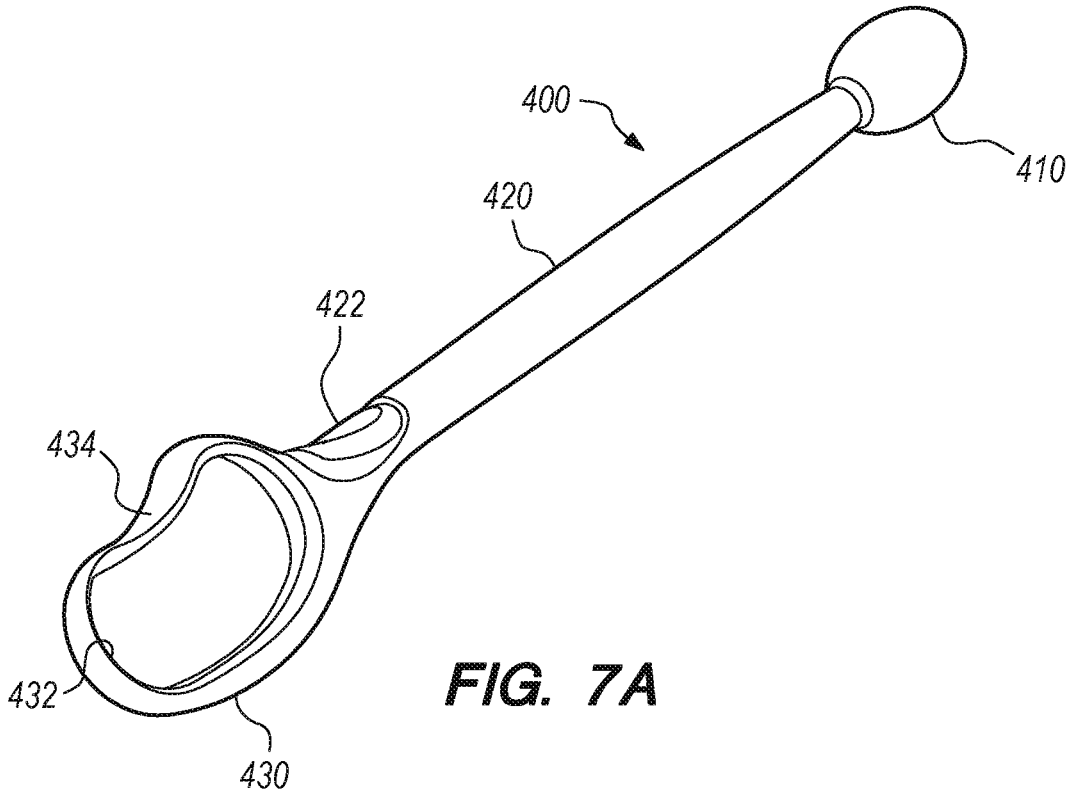
FIG. 7A illustrates a perspective view of a third alternative embodiment of the universal drumstick.

FIG. 7A illustrates a third alternative embodiment of the universal drumstick 400 and is the preferred embodiment. FIG. 7A illustrates a perspective view of universal drumstick 400. Universal drumstick 400 comprises a tip 410, a shaft 420, and a handle 430. A grip 432 is disposed therethrough handle 430. In a further preferred embodiment, a curve 434 is within grip 432 and is inwardly contoured. When universal drumstick 400 is in use, preferably, curve 434 contours with the drummer's pinkie and ring fingers and particularly the interstitial space between the drummer's pinkie and ring fingers. Universal drumstick 400 further comprising a finger pad 422 disposed distally to grip 430 and on the lower surface of shaft 420. Finger pad 422 contacts the top side of a portion of the drummer's middle finger. It has been found that during prolonged playing and especially vigorous playing, that the top of the drummer's middle finger may be abraded also referred to as rubbed, unpleasantly by universal drumstick 400. Finger pad 422 is a preferred embodiment and is preferably circular or oblong in shape. It has been found that finger pad 422 minimizes or prevents abrasions to the drummer's middle finger while playing. FIG. 7A illustrates finger pad 422 on universal drumstick 400 used for the drummer's left hand, finger pad 422 may also be used on the universal drumstick used on the right hand or the left hand or both. Finger pad 422 may be thought of as distributing the force when the drumstick is playing drums. During experimental use, it has been found that use of the finger pad 422 reduces bruises and otherwise mitigates wear and tear on the drummer's hands. Particularly, the drummer's middle finger. As illustrated in FIGS. 5A-5F and 6A-6F, finger pad 422 may be used in conjunction with other embodiments of the universal drumstick. Finger pad 422 may also be used in the first embodiment of the universal drumstick 200 and the second embodiment of the universal drumstick 300 and serves the same purpose as when used with universal drumstick 400.

Figure 7B:
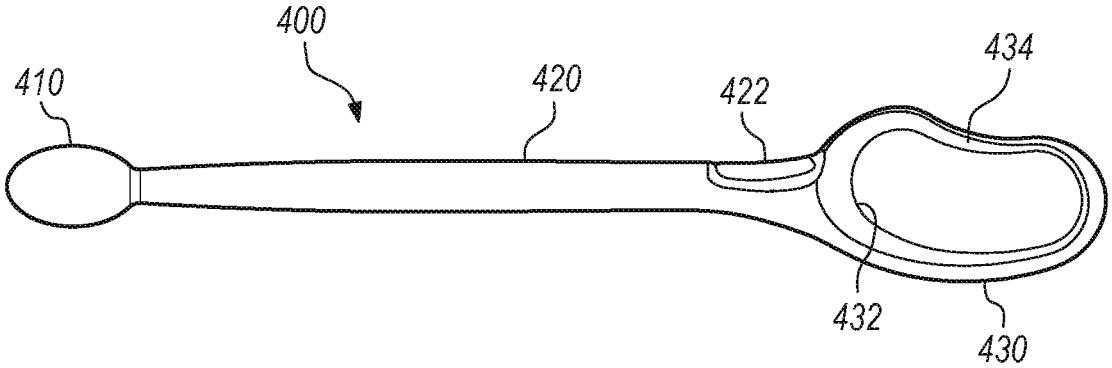
FIG. 7B illustrates a right side view of the third alternative embodiment of the universal drumstick. The left side view is a mirror image.

FIG. 7B illustrates left side view of the universal drumstick 400. Grip 432 is disposed therethrough handle 430. In a preferred embodiment, curve 434 is within grip 432 and is inwardly contoured. When universal drumstick 400 is in use on a drummer's hand, curve 434 contours with the drummer's pinkie and ring fingers and particularly the interstitial space between the drummer's pinkie and ring fingers.

Figure 7C:
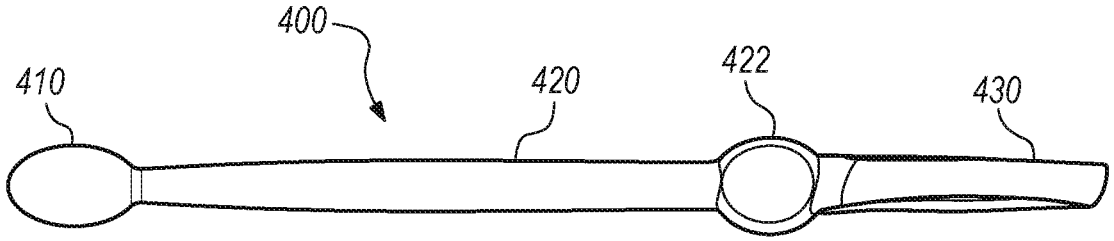
FIG. 7C illustrates a bottom view of the third alternative embodiment universal drumstick.

FIG. 7C illustrates is a bottom view of the universal drumstick 400. Tip 410, shaft 420, and grip 430 are also illustrated. Tip 210, shaft 220, and grip 230 are also illustrated. As a further preferred embodiment, universal drumstick 400 comprises finger pad 422.

Figure 7D:
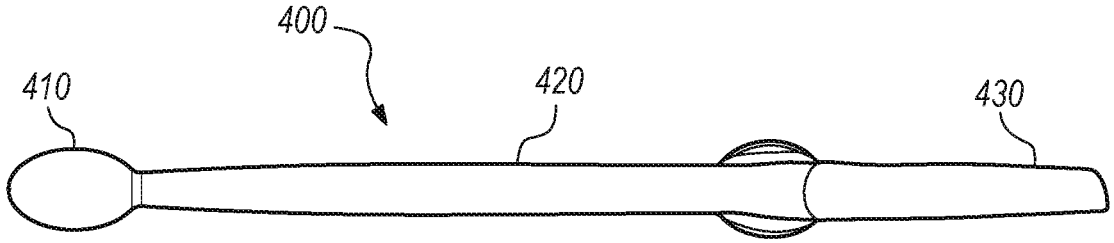
FIG. 7D illustrates a top view of third alternative embodiment the universal drumstick.

FIG. 7D illustrates a top view of the universal drumstick 400. Tip 410, shaft 420, and grip 430 are also illustrated.

Figure 7E:
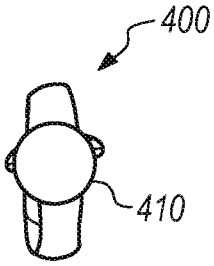
FIG. 7E illustrates a front view of third alternative embodiment the universal drumstick.

FIG. 7E illustrates a front view of the universal drumstick 400.

Figure 7F:
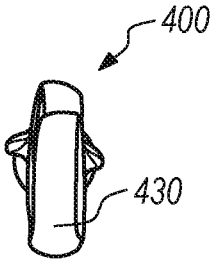
FIG. 7F illustrates a rear view of third alternative embodiment the universal drumstick.

FIG. 7F illustrates a rear view of universal drumstick 400. Grip 430 is also illustrated.

FIG. 8 illustrates a perspective view of the drummer using the universal drumstick 100 to play a hand-drum and a stick-drum at the same time using a pair of universal drumsticks 100. FIG. 8 illustrates that the drummer can concurrently play both stick-drums and hand-drums without putting down or picking back up the drumstick 100. As discussed above, if the drummer were using the conventional drumstick S, the drummer would have to put down drumstick S in order to play the hand-drum.

Universal drumsticks 100, 200, 300, and 400 may be made from wood, nylon, polycarbonate, polypropylene, and other types of plastics. Most typically, wooden drumsticks are made from hickory, maple or oak wood. The universal drumsticks could also be made of metal or carbon fiber. These are non-limiting examples and the universal drumsticks could be made of other materials.

Figure 9:
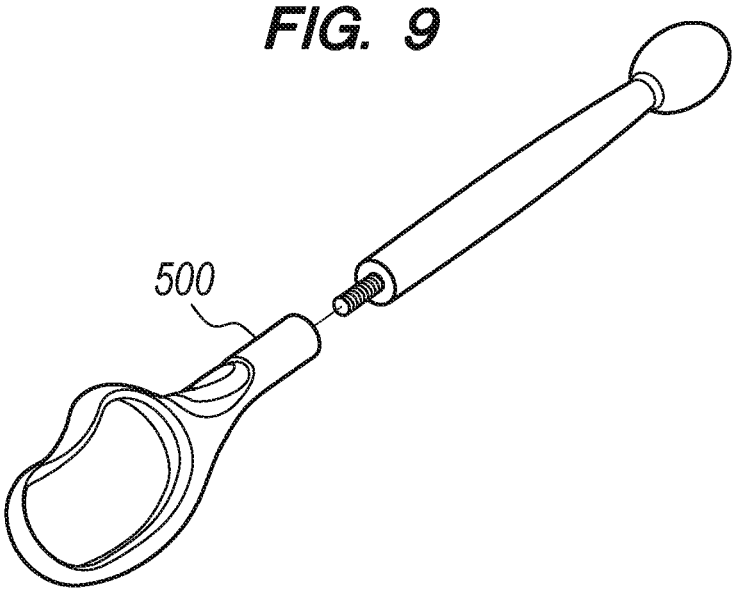
FIG. 9 illustrates a perspective view of a fourth alternative embodiment of the universal drumstick.

For example, as illustrated in FIG. 9, a fourth embodiment of universal drumstick 500, a stainless steel handle that is screwed into a wooden shaft or attachable by a male-female connector. Alternatively, the universal drumsticks 100, 200, 300, and 400 may be made from dissimilar materials. As a further alternative, drumstick 100, 200, 300, 400, 500 could have a tip made from a material that is different than the rest of the drumstick. A still further alternative could be drumsticks of different lengths.

While the invention has been illustrated and described in detail in the drawings and description, the same is to be considered as an illustration and is not limited to the exact embodiments shown and described. All equivalents, changes and modifications that come within the spirit of the invention are also protected by the claims that are set forth below.

What I claimed is:

1. A universal drumstick for use by a drummer, the drummer having a hand with a thumb, an index finger, a middle finger, a ring finger, and a pinkie finger, comprising:

a distal tip;

a shaft proximal to the distal tip;

a handle proximal to the shaft, the handle having a grip therethrough, the grip sized to allow the drummer's little finger and ring finger to extend therethrough, the shaft angled relative to the handle such that at least a portion of the shaft is above the drummer's middle and index fingers when the drummer's pinkie and ring fingers are within the grip, and a curve within the grip, the curve inwardly contoured with the drummer's pinkie and ring fingers;

whereby the drummer can play a stick-drum with the universal drumstick and also play a hand-drum without removing the universal drumstick from the drummer's hand.

2. The universal drumstick of claim 1, further comprising:

a finger pad, the finger pad disposed distally to the grip and on the lower surface the shaft, the finger pad contacting the top of a portion of the drummer's middle finger;

whereby the finger pad minimizes abrasions to the drummer's middle finger while playing.

3. The universal drumstick of claim 2, further comprising: the finger pad is circular or oval.

4. The universal drumstick of claim 2, further comprising: the universal drumstick is made from a material selected from the group consisting of: a wood, a nylon, a polycarbonate, a polypropylene, a plastic, a metal, and a carbon fiber.

5. The universal drumstick of claim 2, further comprising: the handle and the shaft of the universal drumstick are made from dissimilar materials.

6. The universal drumstick of claim 2, further comprising: the shaft is detachable from the handle of the universal drumstick.

7. A universal drumstick for use by a drummer, the drummer having a hand with a thumb, an index finger, a middle finger, a ring finger, and a pinkie finger, comprising:

a distal tip;

a shaft proximal to the distal tip;

a handle proximal to the shaft, the handle having a pinkie-finger hole and a ring-finger hole therethrough, the shaft angled relative to the handle such that at least a portion of the shaft is above the drummer's middle and index fingers when the drummer's pinkie and ring fingers are within their respective hole;

whereby the drummer can play a stick-drum with the universal drumstick and also play a hand-drum without removing the universal drumstick from the drummer's hand.

8. The universal drumstick of claim 7, further comprising: a finger pad, the finger pad disposed distally to the grip and on the lower surface the shaft, the finger pad contacting the top of a portion of the drummer's middle finger;

whereby the finger pad minimizes abrasions to the drummer's middle finger while playing.

9. The universal drumstick of claim 8, further comprising: the finger pad is circular or oval.

10. The universal drumstick of claim 8, further comprising: the universal drumstick is made from a material selected from the group consisting of: a wood, a nylon, a polycarbonate, a polypropylene, a plastic, a metal, and a carbon fiber.

11. The universal drumstick of claim 8, further comprising: the handle and the shaft of the universal drumstick are made from dissimilar materials.

12. The universal drumstick of claim 7, further comprising: the shaft is detachable from the handle of the universal drumstick.

13. A universal drumstick for use by a drummer, the drummer having a hand with a thumb, an index finger, a middle finger, a ring finger, and a pinkie finger, comprising:

a distal tip;

a shaft proximal to the distal tip;

a handle proximal to the shaft, the handle having a grip therethrough, the grip sized to allow the drummer's little finger and ring finger to extend therethrough, the shaft angled relative to the handle such that at least a portion of the shaft is above the drummer's middle and index fingers when the drummer's pinkie and ring fingers are within the grip, the handle further comprising a gap and opposing segments, wherein when universal drumstick is in use, the opposing segments contour with the drummer's pinkie and ring fingers and the gap is situated proximate the interstitial space between the drummer's pinkie and ring fingers;

whereby the drummer can play a stick-drum with the universal drumstick and also play a hand-drum without removing the universal drumstick from the drummer's hand.

14. The universal drumstick of claim 13, further comprising:

a finger pad, the finger pad disposed distally to the grip and on the lower surface the shaft, the finger pad contacting the top of a portion of the drummer's middle finger;

whereby the finger pad minimizes abrasions to the drummer's middle finger while playing.

15. The universal drumstick of claim 14, further comprising: the finger pad is circular or oval.

16. The universal drumstick of claim 13, further comprising: the universal drumstick is made from a material selected from the group consisting of: a wood, a nylon, a polycarbonate, a polypropylene, a plastic, a metal, and a carbon fiber.

17. The universal drumstick of claim 13, further comprising: the handle and the shaft of the universal drumstick are made from dissimilar materials.

18. The universal drumstick of claim 13, further comprising: the shaft is detachable from the handle of the universal drumstick.

19. The universal drumstick of claim 18, further comprising: the shaft is attachable to the handle of the universal drumstick by a male-female connector.

* * * * *